US008657400B2

(12) United States Patent
Ozawa

(10) Patent No.: US 8,657,400 B2
(45) Date of Patent: Feb. 25, 2014

(54) LIQUID DISCHARGING APPARATUS AND LIQUID DISCHARGING METHOD

(75) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 180 days.

(21) Appl. No.: 12/698,738

(22) Filed: Feb. 2, 2010

(65) Prior Publication Data

US 2010/0194804 A1 Aug. 5, 2010

(30) Foreign Application Priority Data

Feb. 3, 2009 (JP) ..... 2009-023060

(51) Int. Cl.
*B41J 29/38* (2006.01)

(52) U.S. Cl.
USPC ..... 347/11; 347/10

(58) Field of Classification Search
USPC ..... 347/10, 11
See application file for complete search history.

(56) References Cited

U.S. PATENT DOCUMENTS

| | | | | |
|---|---|---|---|---|
| 6,318,829 | B1 * | 11/2001 | Suzuki | 347/11 |
| 6,412,923 | B1 | 7/2002 | Takahashi | |
| 6,460,959 | B1 * | 10/2002 | Momose et al. | 347/11 |
| 6,969,138 | B2 * | 11/2005 | Ikeda et al. | 347/11 |
| 7,125,107 | B2 * | 10/2006 | Satake et al. | 347/68 |
| 7,249,816 | B2 * | 7/2007 | Kusunoki et al. | 347/10 |
| 7,413,292 | B2 * | 8/2008 | Satake et al. | 347/72 |
| 7,695,086 | B2 * | 4/2010 | Iwao et al. | 347/11 |
| 7,866,776 | B2 * | 1/2011 | Watanabe | 347/10 |
| 2006/0125856 | A1 * | 6/2006 | Kitami et al. | 347/10 |
| 2009/0147034 | A1 * | 6/2009 | Yoshida | 347/10 |

FOREIGN PATENT DOCUMENTS

| | | | | |
|---|---|---|---|---|
| JP | 05-169664 A | * | 7/1993 | B41J 2/05 |
| JP | 05-318766 A | | 12/1993 | |
| JP | 05-338150 A | | 12/1993 | |
| JP | 2000-052561 A | | 2/2000 | |
| JP | 2002-225250 A | | 8/2002 | |
| JP | 2004-209843 A | | 7/2004 | |

* cited by examiner

*Primary Examiner* — Julian Huffman
*Assistant Examiner* — Sharon A Polk
(74) *Attorney, Agent, or Firm* — Kilpatrick Townsend & Stockton LLP

(57) ABSTRACT

A liquid discharging apparatus is provided, which including: a pressure chamber communicating with a liquid supply portion and each nozzle; an element that performs an operation for providing change of pressure to liquid within the pressure chamber; and a pulse generating section that generates a pulse of which a voltage is changed to operate the element. The pulse generating section generates a first discharge pulse that causes the element to perform an operation for discharging liquid droplets from the nozzles, a non-discharge pulse, generated later than the first discharge pulse, that produces pressure vibration of strength, by which the liquid droplets are not discharged from the nozzles, in the liquid within the pressure chamber, which has a phase different from pressure vibration produced in the liquid within the pressure chamber by applying the first discharge pulse to the element, and a second discharge pulse, generated later than the non-discharge pulse, that causes the element to perform the operation for discharging the liquid droplets from the nozzles, while using the pressure vibration produced in the liquid within the pressure chamber by applying the non-discharge pulse to the element.

4 Claims, 12 Drawing Sheets

LIQUID DISCHARGING APPARATUS AND LIQUID DISCHARGING METHOD

BACKGROUND

1. Technical Field

The present invention relates to a liquid discharging apparatus, and a liquid discharging method.

2. Related Art

In liquid discharging apparatuses such as an ink jet printer, the distance between discharge pulses included in a repetition period is generally determined on the basis of landing positions of ink drops (see, for example, JP-A-2002-225250).

In recent years, attempts have been made to discharge higher viscosity liquid than aqueous ink typically used (referred to as high viscosity liquid, for convenience) by applying the technology of ink jet printers. When such high viscosity liquid is discharged, resistance with a flow channel is high due to the high viscosity, and there may be cases where discharge of liquid by a subsequent discharge pulse is affected by residual vibration produced in liquid within a pressure chamber with the application of a more considerable previous discharge pulse than low viscosity liquid such as ink in the related art. Herewith, there has been a problem that the amount of liquid droplets discharged by the subsequent discharge pulse or flying speed thereof is significantly deviated compared to liquid droplets discharged by the previous discharge pulse.

SUMMARY

An advantage of some aspects of the invention is to provide a liquid discharging apparatus and a liquid discharging method capable of suppressing adverse affects of the previous discharge pulse, when high viscosity liquid is discharged by the subsequent discharge pulse.

According to a first aspect of the invention, there is provided a liquid discharging apparatus including: a pressure chamber communicating with a liquid supply portion and each nozzle; an element that performs an operation for providing change of pressure to liquid within the pressure chamber; and a pulse generating section that generates a pulse of which a voltage is changed to operate the element. The pulse generating section generates a first discharge pulse that causes the element to perform an operation for discharging liquid droplets from the nozzles, a non-discharge pulse, generated later than the first discharge pulse, that produces pressure vibration of strength, by which the liquid droplets are not discharged from the nozzles, in the liquid within the pressure chamber, which has a phase different from pressure vibration produced in the liquid within the pressure chamber by applying the first discharge pulse to the element, and a second discharge pulse, generated later than the non-discharge pulse, that causes the element to perform the operation for discharging the liquid droplets from the nozzles, while using the pressure vibration produced in the liquid within the pressure chamber by applying the non-discharge pulse to the element.

The above and other characteristics of the invention are apparent from the specification and the accompanying drawings.

BRIEF DESCRIPTION OF THE DRAWINGS

The invention will be described with reference to the accompanying drawings, wherein like numbers reference like elements.

FIG. 4 is a block diagram for describing the configuration of a drive signal generating circuit and the like.

DESCRIPTION OF EXEMPLARY EMBODIMENTS

Figure 1:
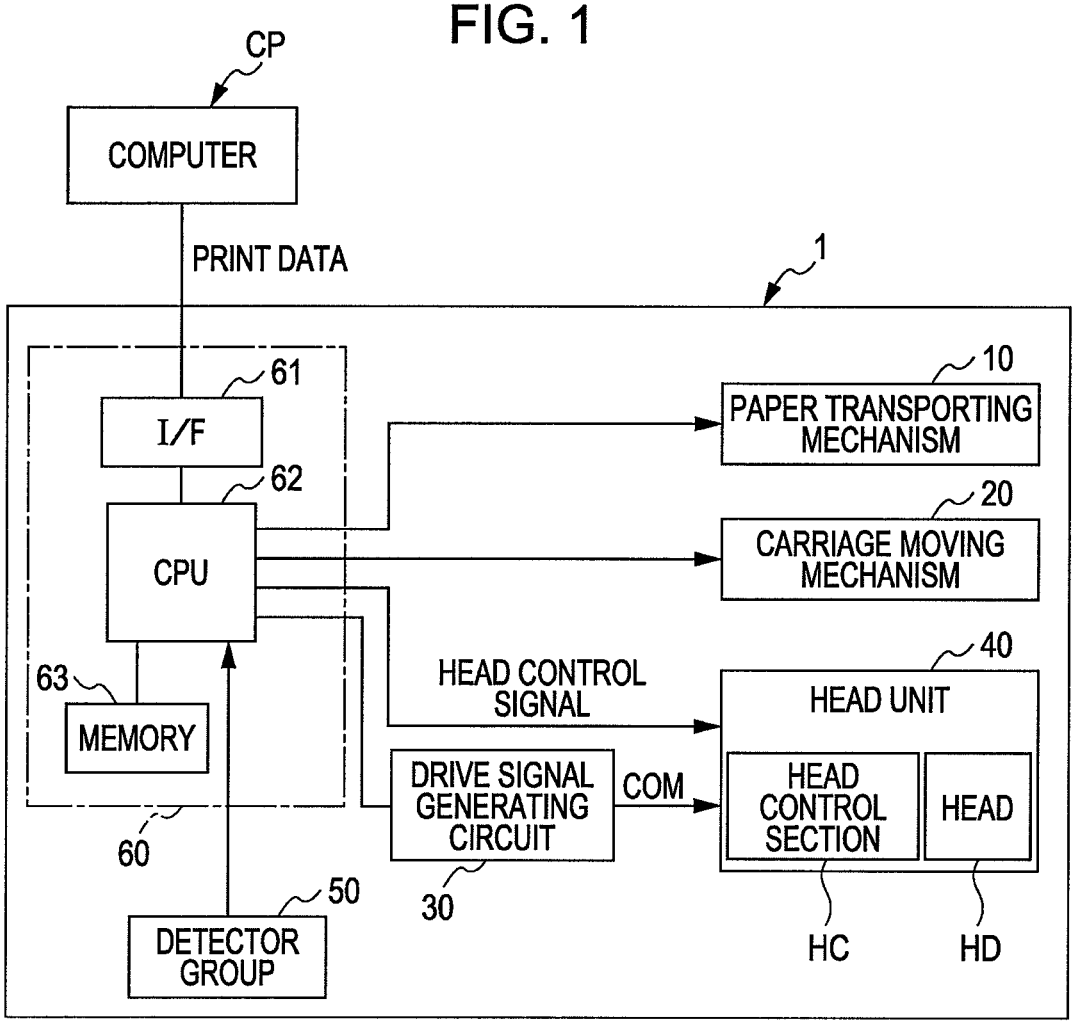
FIG. 1 is a block diagram for describing the configuration of a printing system.

The following are at least apparent from the specification and the accompanying drawings.

That is, it is apparently possible to implement a liquid discharging apparatus, which includes a pressure chamber communicated with a liquid supply portion and each nozzle, an element that performs an operation for providing change of pressure to liquid within the pressure chamber, and a pulse generating section that generates a pulse of which a voltage is changed to operate the element. The pulse generating section generates a first discharge pulse that causes the element to perform an operation for discharging liquid droplets from the nozzles, a non-discharge pulse, generated later than the first discharge pulse, that produces pressure vibration of strength, by which the liquid droplets are not discharged from the nozzles, in the liquid within the pressure chamber, which has a phase different from pressure vibration produced in the liquid within the pressure chamber by applying the first discharge pulse to the element, and a second discharge pulse, generated later than the non-discharge pulse, that causes the element to perform the operation for discharging the liquid droplets from the nozzles, while using the pressure vibration produced in the liquid within the pressure chamber by applying the non-discharge pulse to the element.

With such a liquid discharging apparatus, it is possible to suppress the effect of residual vibration produced by the application of the first discharge pulse and to assist discharge of liquid by the application of the second discharge pulse, through pressure vibration produced by the application of the non-discharge pulse.

In the liquid discharging apparatus, it is preferable that the non-discharge pulse produces pressure vibration, which strengthens the pressure vibration produced in the liquid within the pressure chamber by applying the second discharge pulse to the element, in the liquid within the pressure chamber.

With the liquid discharging apparatus, it is possible to use residual vibration by the non-discharge pulse in discharge of the liquid by the second discharge pulse, and to give larger pressure vibration to the liquid within the pressure chamber.

In the liquid discharging apparatus, it is preferable that the non-discharge pulse produces pressure vibration, which is produced in the liquid within the pressure chamber by applying the first discharge pulse to the element and is stronger than the pressure vibration produced during a period of applying the non-discharge pulse to the element, in the liquid within the pressure chamber.

With the liquid discharging apparatus, it is possible to effectively suppress the effect of pressure vibration produced by the application of the first discharge pulse.

In the liquid discharging apparatus, it is preferable that the first discharge pulse is configured so that an initiation voltage and termination a voltage thereof are both minimum voltages in the first discharge pulse.

With the liquid discharging apparatus, it is possible to sufficiently heighten the wave height of the first discharge pulse, and to positively discharge the high viscosity liquid.

In the liquid discharging apparatus, it is preferable that an initiation voltage and a termination voltage are both the minimum voltages, and are set to have a lower wave height than that of the first discharge pulse.

With the liquid discharging apparatus, since the strength of pressure vibration by the non-discharge pulse is capable of being adjusted by the wave height, the waveform design is easily performed.

In the liquid discharging apparatus, it is preferable that the non-discharge pulse is applied to the element even when liquid droplets are not discharged from the nozzles.

With the liquid discharging apparatus, it is possible to suppress the viscosity increase of the liquid adjacent to the nozzles through pressure vibration produced by the application of the non-discharge pulse.

Further, it is apparently possible to implement a liquid discharging method of discharging liquid from nozzles, using a liquid discharging apparatus including a pressure chamber communicated with a liquid supply portion and each nozzle, an element that performs an operation for providing change of pressure to liquid within the pressure chamber, and a pulse generating section that generates a pulse of which a voltage is changed to operate the element, including: generating a first discharge pulse to apply the first discharge pulse to the element, and causing the element to perform an operation for discharging liquid droplets from the nozzles; generating a non-discharge pulse later than the first discharge pulse to apply the non-discharge pulse to the element, and producing pressure vibration of strength, by which the liquid droplets are not discharged from the nozzles, in the liquid within the pressure chamber, which has a phase different from pressure vibration produced in the liquid within the pressure chamber by the first discharge pulse, and generating a second discharge pulse later than the non-discharge pulse to apply the second discharge pulse to the element, and causing the element to perform the operation for discharging the liquid droplets from the nozzles, while using the pressure vibration produced in the liquid within the pressure chamber by the non-discharge pulse.

First Embodiment

With Respect to Printing System

The printing system shown in FIG. 1 includes a printer 1 and a computer CP. The printer 1 is equivalent to a liquid discharging apparatus, and is configured to discharge ink which is a type of liquid toward mediums such as paper, textile, and films. The mediums are objects to which liquid is discharged. The computer CP is connected to the printer 1 so as to be capable of performing communication with the printer. In order for an image to be printed by the printer 1, the computer CP transmits print data in accordance with the image to the printer 1.

Outline of Printer 1

The printer 1 includes a paper transporting mechanism 10, a carriage moving mechanism 20, a drive signal generating circuit 30, a head unit 40, a detector group 50, and a main control section 60.

Figure 7:
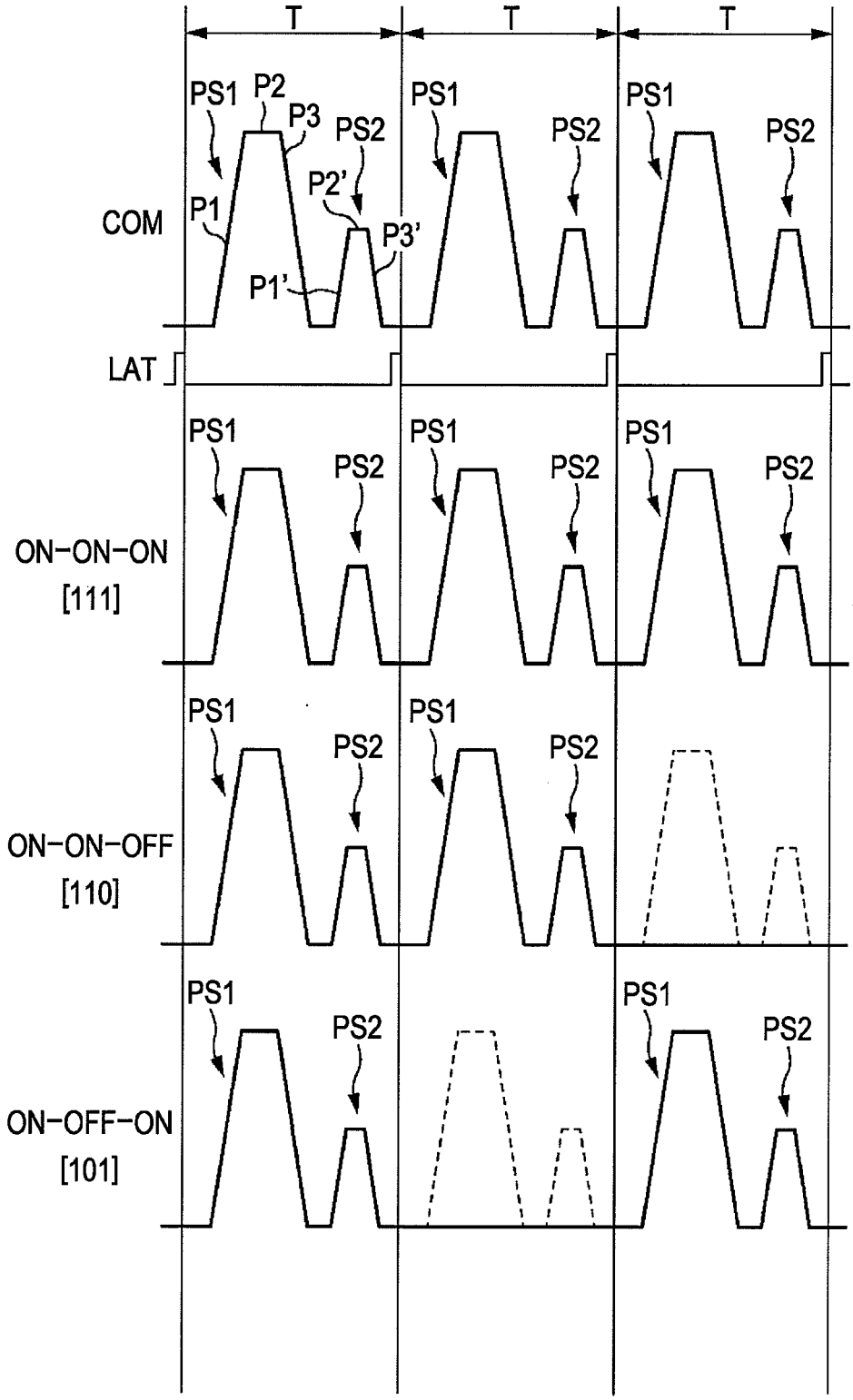
FIG. 7 is a diagram for describing drive signals and dot formation control according a first embodiment.

The paper transporting mechanism 10 is equivalent to a medium transporting section, and transports paper used as a medium in a transport direction. The carriage moving mechanism 20 is equivalent to a head movement section, and moves a carriage to which the head unit 40 is attached in a predetermined movement direction (for example, paper width direction (equivalent to an intersection direction intersecting a transport direction)). The drive signal generating circuit 30 generates drive signals COM. The drive signals COM are signals applied to a head HD (piezoelectric element 433; see FIG. 2) at the time of printing on the paper, and a series of signals including discharge pulses PS1 or non-discharge pulses PS2 as shown in FIG. 7 as an example. Here, since droplet-like ink is discharged from the head HD, the discharge pulses PS1 are change patterns of a voltage which makes the piezoelectric element 433 perform a predetermined operation. In addition, since change of pressure equivalent to the extent that ink is not discharged from the head HD is provided to ink within a pressure chamber 424 (see FIG. 2), the non-discharge pulses PS2 are change patterns of a voltage which makes the piezoelectric element 433 perform a predetermined operation. Since the drive signals COM include the discharge pulses PS1 or the non-discharge pulses PS2, the drive signal generating circuit 30 is equivalent to a pulse generating section. Meanwhile, the configuration of the drive signal generating circuit 30 or each of the pulses PS1 and PS2 will be described later. The head unit 40 includes the head HD and a head control section HC. The head HD is a type of liquid discharging head, and discharges ink toward the paper. The head control section HC controls the head HD on the basis of a head control signal from the main control section 60. Meanwhile, the head HD will be described later. The detector group 50 is constituted by a plurality of detectors which monitors the status of the printer 1. The detected results through these detectors are output to the main control section 60. The main control section 60 performs the whole control in the printer 1. The main control section 60 will be described later.

Main Parts of Printer 1

With Respect to Head HD

Figure 2:
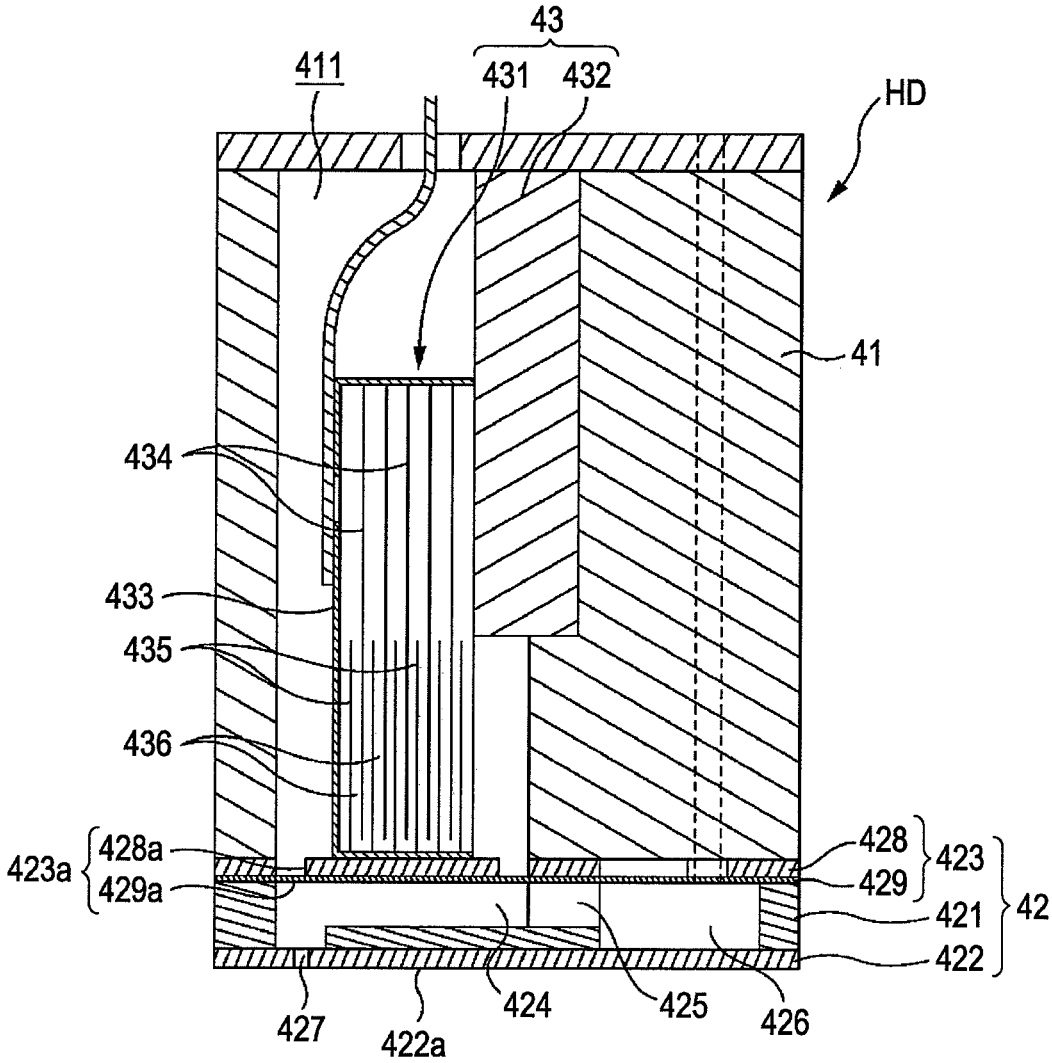
FIG. 2 is a cross-section view of a head.

As shown in FIG. 2, the head HD includes a case 41, a flow channel unit 42, and a piezoelectric element unit 43. A receiving space portion 411 which receives and fixes the piezoelectric element unit 43 is provided in the inside of the case 41. The case 41 is made of, for example, resin material. The flow channel unit 42 is bonded to the apical surface of the case 41.

The flow channel unit 42 includes a flow channel forming substrate 421, a nozzle plate 422, and a diaphragm 423. The nozzle plate 422 is bonded to one surface in the flow channel forming substrate 421, and the diaphragm 423 is bonded to the other surface thereof. A groove portion used as the pressure chamber 424, a groove portion used as an ink supply channel 425, and an opening used as a common ink chamber 426 and the like are formed in the flow channel forming substrate 421. The flow channel forming substrate 421 is made of, for example, a silicon substrate. The pressure chamber 424 is formed as an elongated chamber in a direction intersecting an alignment direction of nozzles 427. The ink supply channel 425 communicates between the pressure chamber 424 and the common ink chamber 426. The ink supply channel 425 supplies ink (a type of liquid) accumulated in the common ink chamber 426 to the pressure chamber 424. Therefore, the ink supply channel 425 is a type of supply portion for supplying liquid to the pressure chamber 424. The common ink chamber 426 is a portion that tentatively accumulates ink supplied from an ink cartridge (not shown), and is equivalent to a common liquid accumulating chamber.

A plurality of nozzles 427 is provided in the nozzle plate 422 at a predetermined distance in a predetermined alignment direction. The ink is discharged through these nozzles 427 to the outside of the head HD. The nozzle plate 422 is made of, for example, a stainless plate or a silicon substrate.

The diaphragm 423 is constituted so that a dual structure that, for example, a resinous elastic film 429 is stacked on a stainless support plate 428 is adopted. Portions corresponding to each pressure chamber 424 in the diaphragm 423 are constituted so that the support plate 428 is processed by etching in a ling-like shape. An insular portion 428*a* is formed within a ring. The insular portion 428*a* and an elastic film 429*a* located at the periphery of the insular portion 428*a* constitute a diaphragm portion 423*a*. The diaphragm portion 423*a* is transformed by a piezoelectric element 433 included in the piezoelectric element unit 43, and is capable of varying a capacity of the pressure chamber 424. That is, the diaphragm portion 423*a* is equivalent to a partitioned portion in which a portion of the pressure chamber 424 is partitioned, and change of pressure is provided to ink (liquid) within the pressure chamber 424 by the transformation.

The piezoelectric element unit 43 includes a piezoelectric element group 431 and a fixed plate 432. The piezoelectric element group 431 has a comb teeth shape. Each of the comb teeth is the piezoelectric element 433. The apical surfaces of each of the piezoelectric elements 433 are bonded to the corresponding insular portion 428*a*. The fixed plate 432 supports the piezoelectric element group 431, and is an attachment portion to the case 41. This fixed plate 432 is made of, for example, a stainless plate, and is bonded to an internal wall of the receiving space portion 411.

The piezoelectric element 433 is a type of electromechanical transducing element, and is equivalent to an element which performs an operation (transformation operation) for providing change of pressure to liquid within the pressure chamber 424. The piezoelectric element 433 shown in FIG. 2 is expanded and contracted in a longitudinal direction of the element intersecting a stacked direction by providing potential difference between adjacent electrodes. That is, the above-mentioned electrodes include a common electrode 434 with a predetermined potential, and a drive electrode 435 with a potential in response to voltages of the drive signals COM (discharge pulse PS1 or non-discharge pulse PS2). A piezoelectric substance 436 interposed between both the electrodes 434 and 435 is transformed to the extent that is in response to potential difference between the common electrode 434 and the drive electrode 435. The piezoelectric element 433 is expanded and contracted in a longitudinal direction of the element in accordance with the transformation of the piezoelectric substance 436. In the embodiment, the common electrode 434 is set to a ground potential, or a bias potential higher by a predetermined potential than the ground potential. The piezoelectric element 433 is contracted to the extent that the potential of the drive electrode 435 is higher than the potential of the common electrode 434. Conversely, the piezoelectric element is expanded to the extent that the potential of the drive electrode 435 is close to the potential of the common electrode 434, or is lower than the potential of the common electrode 434.

As described above, the piezoelectric element unit 43 is attached to the case 41 through the fixed plate 432. For this reason, when the piezoelectric element 433 is contracted, the diaphragm portion 423*a* is tensioned in a direction away from the pressure chamber 424. Herewith, the pressure chamber 424 is expanded. Conversely, when the piezoelectric element 433 is expanded, the diaphragm portion 423*a* is pushed to the pressure chamber 424 side. Herewith, the pressure chamber 424 is contracted. Change of pressure is generated in ink within the pressure chamber 424 due to the expansion or contraction of the pressure chamber 424. That is, the ink within the pressure chamber 424 is pressurized with the contraction of the pressure chamber 424, and the ink within the pressure chamber 424 is depressurized with the expansion of the pressure chamber 424. Since the state of expansion and contraction of the piezoelectric element 433 is determined in response to the potential of the drive electrode 435, the capacity of the pressure chamber 424 is also determined in response to the potential of the drive electrode 435. The potential of the drive electrode 435 is determined in response to voltages of the pulses PS1 and PS2 which the drive signal COM includes. Therefore, the piezoelectric element 433 is an element which transforms the diaphragm portion 423*a* (partitioned portion) to a degree that is in response to change pattern of voltages in each of the applied pulses PS1 and PS2. The extent of pressurization or the extent of depressurization of ink within the pressure chamber 424 can be determined by the amount of potential change and the like per unit time in the drive electrode 435.

With Respect to Ink Flow Channel

Figure 3:
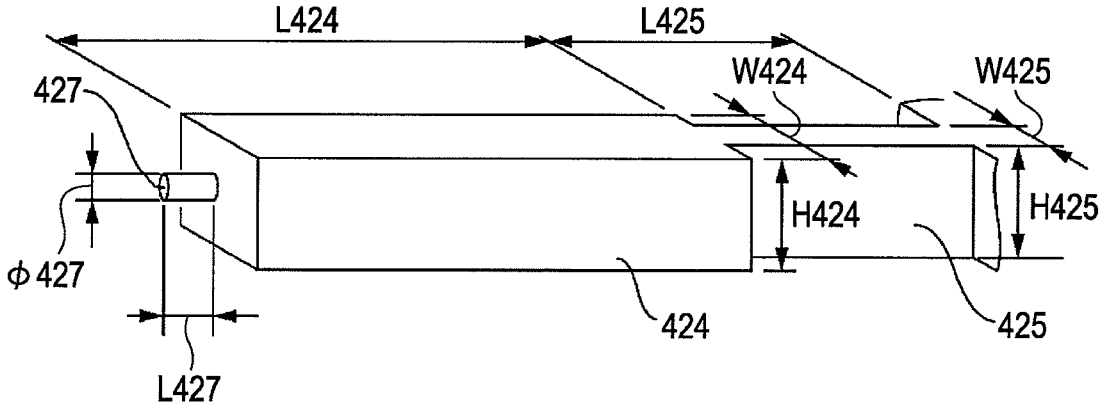
FIG. 3 is a diagram for schematically describing the structure of the head.

A series of plural ink flow channels (equivalent to a liquid flow channel filled with liquid), corresponding to the number of the nozzles 427, extended from the common ink chamber 426 to the nozzles 427 are provided in the head HD. In the ink flow channels, the nozzles 427 and the ink supply channel 425 are, respectively, communicated with each other with respect to the pressure chamber 424. For the cross-section area (cross-section area of a surface intersecting a flow direction of ink) of the flow channel, the cross-section area of the nozzle 427 and the ink supply channel 425 is set to be smaller than the cross-section area of the pressure chamber 424. For this reason, when the characteristics such as the ink flow are analyzed, a Helmholtz resonator approach is applied. FIG. 3 is a diagram for schematically describing the structure of the head HD based on this approach. From the relationship shown schematically, FIG. 3 shows an ink flow channel in a shape different from actuality.

In a typical head HD, the length L424 of the pressure chamber 424 is set to be within a range from 200 μm to 2000 μm. The width W424 of the pressure chamber 424 is set to be within a range from 20 μm to 300 μm, and the height H424 of the pressure chamber 424 is set to be within a range from 30 μm to 500 μm. The length L425 of the ink supply channel 425 is set to be within a range from 50 μm to 2000 μm. The width W425 of the ink supply channel 425 is set to be within a range from 20 μm to 300 μm, and the height H425 of the ink supply channel 425 is set to be within a range from 30 μm to 500 μm. In addition, the diameter ϕ427 of the nozzle 427 is set to be within a range from 10 μm to 40 μm, and the length L427 of the nozzle 427 is set to be within a range from 40 μm 100 μm.

In such an ink flow channel, change of pressure is provided to the ink within the pressure chamber 424, so that the ink is discharged from the nozzles 427. At this time, the pressure chamber 424, the ink supply channel 425, and the nozzles 427 function like a Helmholtz resonator. For this reason, when pressure is applied to the ink within the pressure chamber 424, the magnitude of the pressure is changed by an inherent period called a Helmholtz period. That is, pressure vibration is generated in ink.

Here, the Helmholtz period (inherent vibration period of ink) Tc can be generally represented as the following formulas (1) and (2).

$$Tc=1/f \quad (1)$$

$$f=\tfrac{1}{2}\pi\sqrt{[(Mn+Ms)/(Mn\times Ms\times(Cc+Ci))]} \quad (2)$$

In the formula (1), Mn denotes inertance of the nozzle 427 (mass of ink per unit cross-section area), Ms denotes inertance of the ink supply channel 425, Cc denotes compliance of the pressure chamber 424 (which shows capacity change per unit pressure, or the extent for flexibility), Ci denotes compliance of ink (Ci=volume V/[density ρ×sound speed $c^2$]).

The amplitude of the pressure vibration makes the ink flow channel gradually small by the flow of ink. For example, the pressure vibration is damped due to a loss in the nozzles 427 or the ink supply channel 425, and a loss in a wall portion and the like for partitioning the pressure chamber 424. Here, high-viscosity ink is allowed to flow into a minute flow channel of the nozzle 427 and the like, so that there may be cases where large flow channel resistance and pressure vibration different from low-viscosity ink (also referred to as low-viscosity ink) in the related art are generated from the wall portion and the like.

In a typical head HD, the Helmholtz period in the pressure chamber 424 is set to be within a range from 5 μs to 10 μs. For example, in the ink flow channel shown in FIG. 3, the width W424 of the pressure chamber 424 is set to 100 μm, and the height H424 thereof is set to 70 μm, the length L424 thereof is set to 1000 μm. The width W425 of the ink supply channel 425 is set to 50 μm, the height H425 thereof is set to 70 μm, and the length L425 thereof is set to 500 μm. When the diameter ϕ427 of the nozzle 427 is set to 30 μm, and the length L427 thereof is set to 100 μm, the Helmholtz period is set to a degree of 8 μs. Meanwhile, the Helmholtz period is changed even by the thickness of the wall portion for partitioning the adjacent pressure chambers 424, the thickness or compliance of the elastic film 429, and materials of the flow channel forming substrate 421 or the nozzle plate 422.

With Respect to Main Control Section 60

The main control section (main controller) 60 performs the whole control in the printer 1. For example, controlled objects are controlled on the basis of print data received from the computer CP or the detected results from each of the detectors, and an image is printed on paper. As shown in FIG. 1, the main control section 60 includes an interface section 61, a CPU 62, and a memory 63. The interface section 61 performs exchange of data between the computer CP and the interface section. The CPU 62 performs the whole control of the printer 1. The memory 63 secures an area for storing computer program or a working area and the like. The CPU 62 controls each of the control objects in accordance with computer programs stored in the memory 63. For example, the CPU 62 controls the paper transporting mechanism 10 or the carriage moving mechanism 20. In addition, the CPU 62 transmits head control signals for controlling an operation of the head HD to the head control section HC, or transmits control signals for generating the drive signals COM to the drive signal generating circuit 30.

Here, the control signals for generating the drive signals COM are also called DAC data, and are, for example, digital data of a plurality of bits. The DAC data determine change pattern of voltages in the drive signals COM to be generated. Therefore, the DAC data may also be data showing voltages of the drive signal COM or each of the pulses PS1 and PS2. The DAC data are stored in a predetermined area of the memory 63, and are read out at the time of generation of the drive signals COM and are output to the drive signal generating circuit 30.

With Respect to Drive Signal Generating Circuit 30

Figure 4:
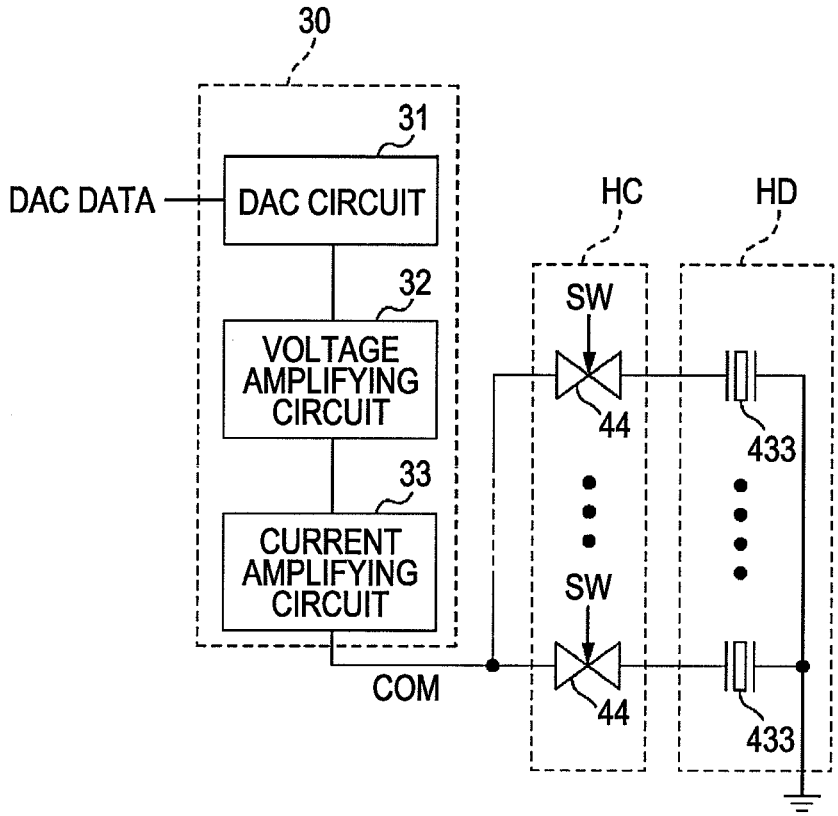

The drive signal generating circuit 30 is a drive signal generating section in which the drive signals COM are generated, and functions as a pulse generating section as well. The drive signals COM including the discharge pulse PS1 or the non-discharge pulse PS2 are generated on the basis of the DAC data. As shown in FIG. 4, the drive signal generating circuit 30 includes a DAC circuit 31, a voltage amplifying circuit 32, and a current amplifying circuit 33. The DAC circuit 31 converts digital DAC data into analog signals. The voltage amplifying circuit 32 amplifies a voltage of the analog signal converted by the DAC circuit 31 up to a level capable of driving the piezoelectric element 433. In the printer 1, the analog signal output from the DAC circuit 31 is maximum 3.3 V, and the analog signal after the amplification (referred to as waveform signal for convenience) output from the voltage amplifying circuit 32 is maximum 42 V compared to this. The current amplifying circuit 33 performs amplification of current on the waveform signal from the voltage amplifying circuit 32, and outputs the waveform signal as the drive signal COM. The current amplifying circuit 33 is constituted by a pair of transistors which are connected, for example, in a push-pull manner.

With Respect to Head Control Section HC

The head control section HC selects a requisite portion of the drive signal COM, generated by the drive signal generating circuit 30, on the basis of the head control signal, and applies it to the piezoelectric element 433. For this reason, the head control section HC includes a plurality of switches 44 provided for each piezoelectric element 433 in the supply line of the drive signal COM, as shown in FIG. 4. The head control section HC generates a switch control signal from the head control signal. The requisite portion of the drive signal COM, for example, the discharge pulse PS1 or the non-discharge pulse PS2 is applied to the piezoelectric element 433 by controlling each of the switches 44 by the switch control signal. At this time, depending the way of selecting the requisite portion, discharge of ink from the nozzle 427 can be controlled. For example, the requisite pulses PS1 and PS2 are selected in response to a dot grayscale, to thereby allow them to be applied to the piezoelectric element 433. Such a head control section HC is equivalent to a pulse selection application section which selects each of the pulses PS1 and PS2 included in the drive signal COM in response to the head control signal from the main control section 60, and applies them to the piezoelectric element 433.

With Respect to Reference Example

Figure 5:
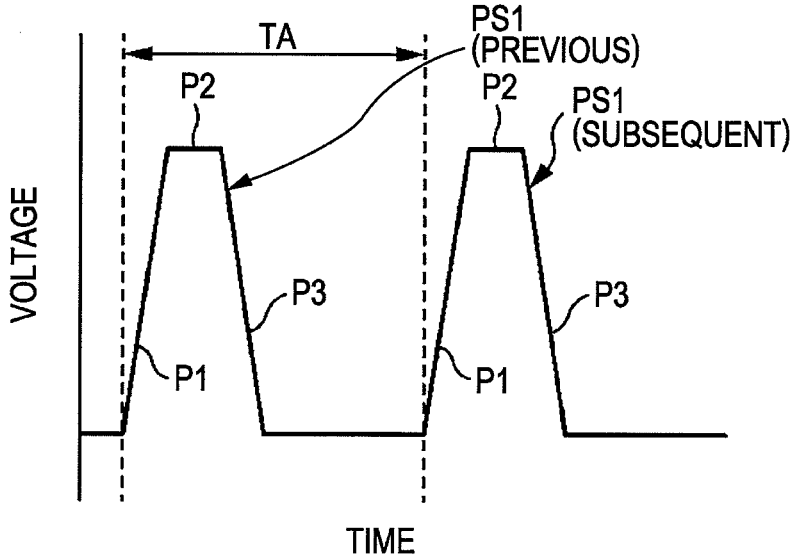
FIG. 5 is a diagram for describing a drive signal of a reference example.
Figure 6:
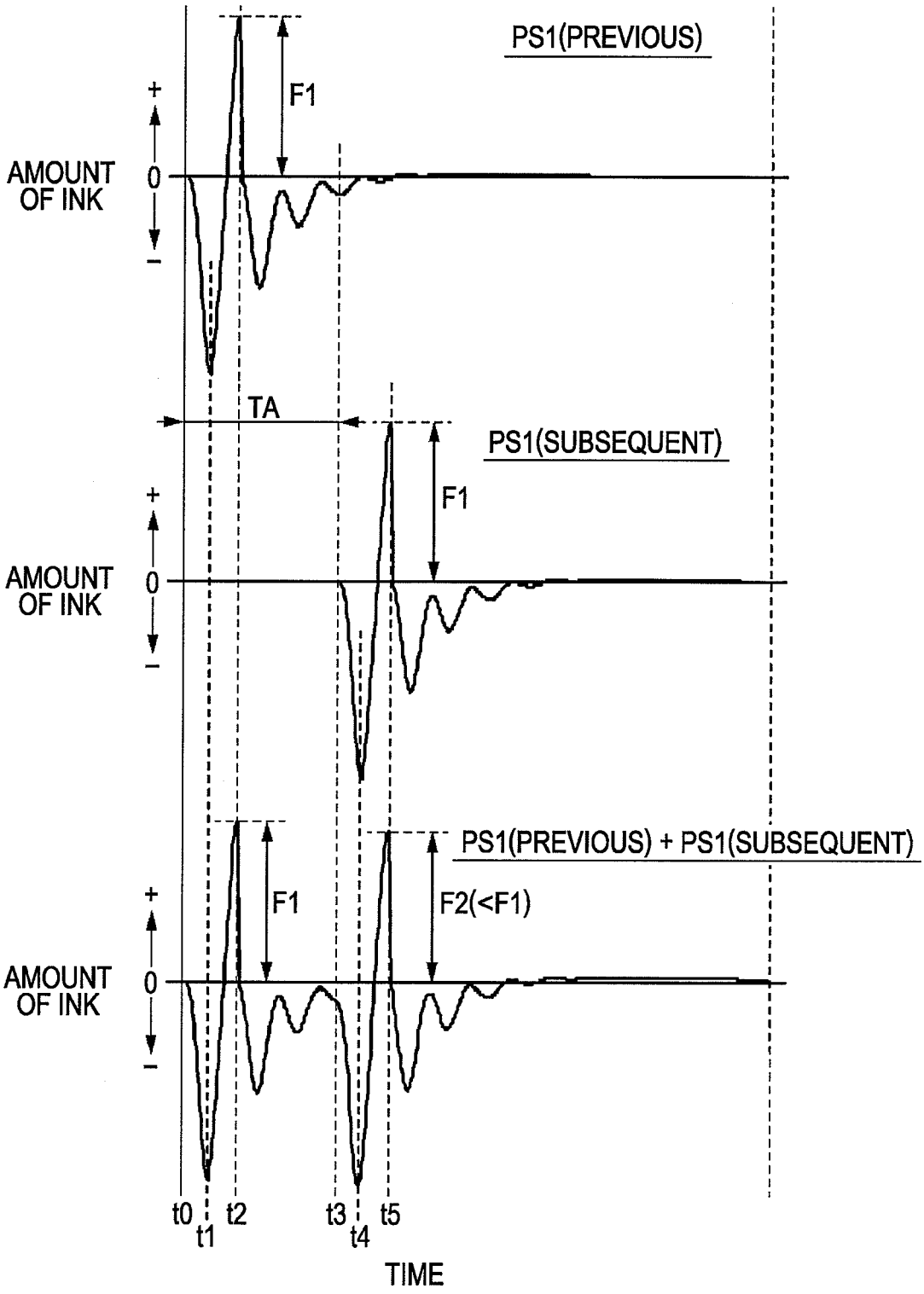
FIG. 6 is a diagram for describing problems of the reference example.
Figure 8:
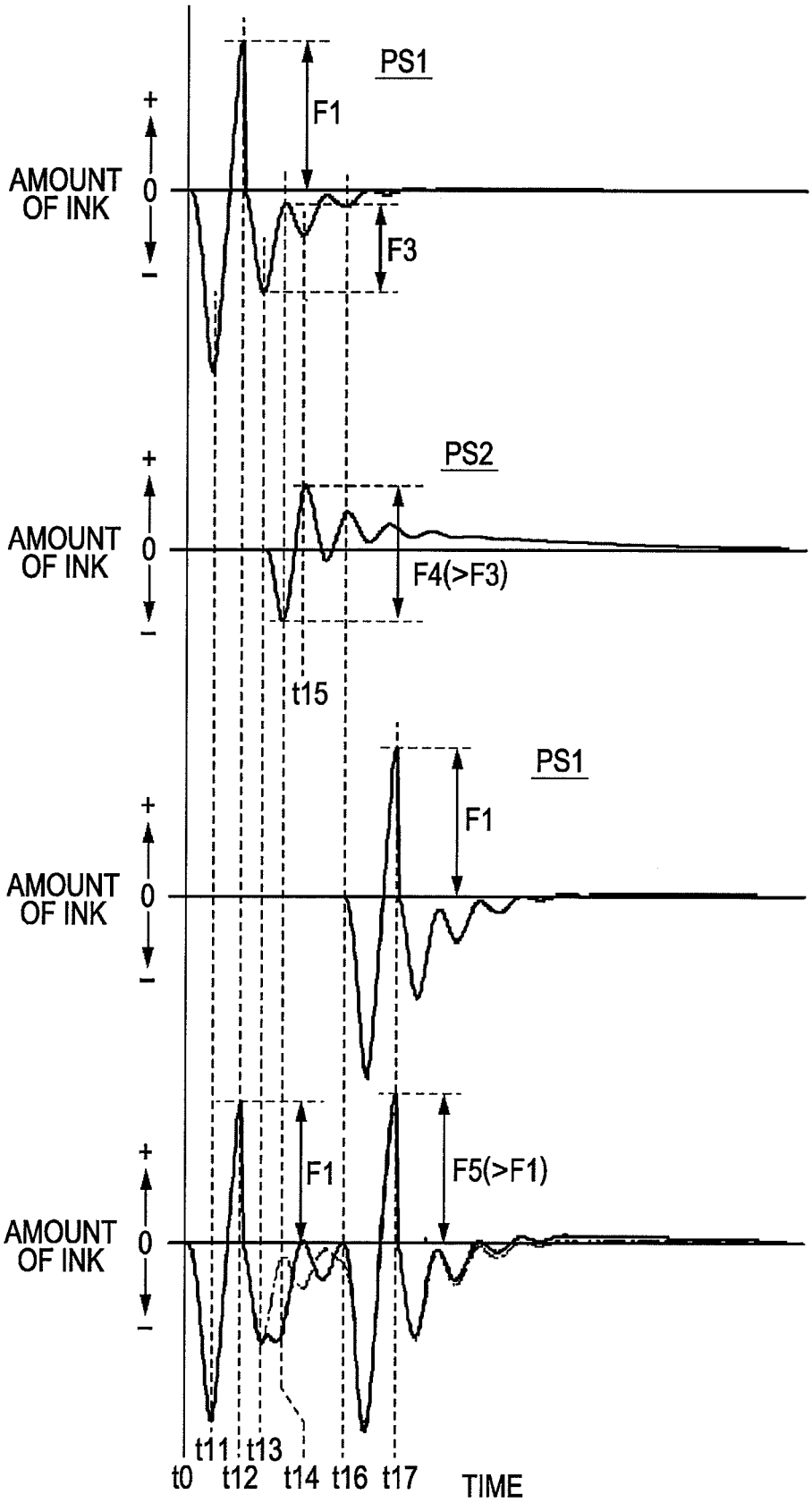
FIG. 8 is a diagram for describing a state change of a meniscus in the first embodiment.
Figure 9:
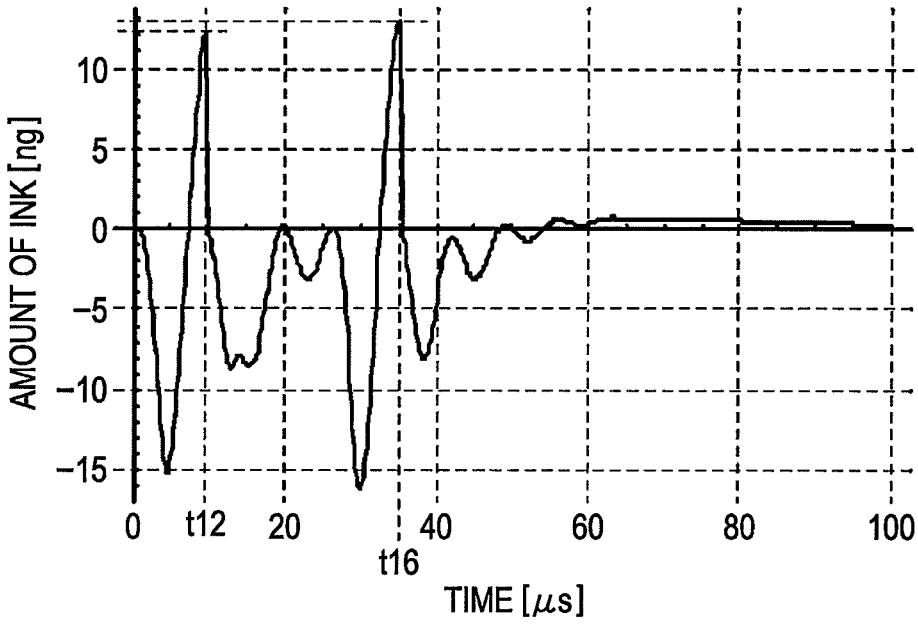
FIG. 9 is a diagram for describing actions of non-discharge pulses in the first embodiment.

Before a discharge operation by the printer 1 according to the embodiment is described, a discharge operation of the reference example will be described. Here, FIG. 5 is a diagram for describing drive signals of the reference example, and FIG. 6 is a diagram for describing problems of the reference example. In FIG. 6, the vertical axis indicates the state of a meniscus (free surface of ink exposed by the nozzles 427) as the amount of ink, and the horizontal axis indicates time. For the vertical axis, 0 is indicative of a position of the meniscus in a steady state. As a value becomes larger in the positive side, the meniscus becomes a state extruded in a discharge direction. Conversely, as a value becomes larger in the negative side, the meniscus becomes a state drawn into the pressure chamber 424 side. The content of the vertical axis and the horizontal axis is equally applied to the vertical axis and the horizontal axis of the other drawings (FIG. 8 or FIG. 9 and the like). For this reason, the descriptions in the other drawings will be omitted.

As shown in FIG. 5, the drive signals of the reference example include two discharge pulses PS1 and PS1. For convenience, the discharge pulse first generated is set to a discharge pulse PS1 (previous), and the discharge pulse later generated is set to a discharge pulse PS1 (subsequent). The discharge pulse PS1 (previous) and the discharge pulse PS1 (subsequent) are constituted by trapezoidal waves made of all the same waveform shapes (change pattern of voltage). That is, they have a decompression portion P1, a maintenance portion P2, and a pressurization portion P3. The discharge pulse PS1 (subsequent) starts generation thereof after the elapse of a period TA from the discharge pulse PS1 (previous).

First of all, the meniscus movement in the case where only the discharge pulse PS1 (previous) is applied to the piezoelectric element 433 will be described. In this case, as shown in the upper stage of FIG. 6, the decompression portion P1 which the discharge pulse PS1 (previous) includes is applied to the piezoelectric element 433 from timing t0. When the decompression portion P1 is applied to the piezoelectric element 433, the pressure chamber 424 is expanded. The ink within pressure chamber 424 becomes negative pressure with the expansion, and the ink flows into the pressure chamber 424 through the ink supply channel 425. In addition, as the ink becomes negative pressure, the meniscus is drawn into the pressure chamber 424 side (−side) within the nozzles 427.

The movement to the pressure chamber 424 side of the meniscus is continued even after the application of the decompression portion P1 is terminated. That is, the meniscus is moved to the pressure chamber 424 side even during the application period of the maintenance portion P2 by compliance and the like of the wall portion for partitioning the pressure chamber 424 or the diaphragm 423. After that, the direction of movement of the meniscus is reversed at timing t1. At this time, the contraction of the pressure chamber 424 with the application of the pressurization portion P3 is also applied. For this reason, ink pressure within the pressure chamber 424 becomes high, and the meniscus is moved to the discharge side (+side) at high speed. The meniscus moved with the application of the pressurization portion P3 becomes columnar. At timing t2 after the application of the pressurization portion P3 to the piezoelectric element 433 is terminated, a portion of the tip of the columnar meniscus is cut off, and is discharged in a droplet-like shape. Meanwhile, in FIG. 6, the amount F1 of ink at timing t2 indicates the amount of discharged ink drops.

The meniscus returns to the pressure chamber 424 side at high speed by the retroaction of discharge. When sufficiently drawn into the pressure chamber 424 side, the meniscus switches the direction of movement to the discharge side. After that, the meniscus switches the direction of movement to the pressure chamber 424 side and the discharge side and is moved, to thereby come close to the steady state. In this manner, the movement of the meniscus to the pressure chamber 424 side and the discharge side is caused by the pressure vibration (residual vibration after discharge of the ink drops) of ink within the pressure chamber 424. Therefore, the pressure of ink within the pressure chamber 424 is changed by the Helmholtz period Tc.

Next, the meniscus movement in the case where only the discharge pulse PS1 (subsequent) is applied to the piezoelectric element 433 will be described. Meanwhile, since the discharge pulse PS1 (previous) and the discharge pulse PS1 (subsequent) are all the same waveforms (change pattern of voltage), the movement of the meniscus is the same as the case where the discharge pulse PS1 (previous) is applied to the piezoelectric element 433. Therefore, the description thereof is simply made. As shown in the middle stage of FIG. 6, the decompression portion P1 which the discharge pulse PS1 (subsequent) includes is applied to the piezoelectric element 433 from timing t3. When the decompression portion P1 is applied to the piezoelectric element 433, the meniscus is drawn into the pressure chamber 424 side (−side) within the nozzles 427. After that, the direction of movement of the meniscus is reversed at timing t4, and the pressurization portion P3 is applied to the piezoelectric element 433. For this reason, the meniscus is moved to the discharge side at high speed. At timing t5, a portion of the tip of the columnar meniscus is cut off, and is discharged in a droplet-like shape. The amount F1 of ink at timing t5 is the same as the discharge pulse PS1 (previous).

Next, the movement of the meniscus in the case where the discharge pulse PS1 (previous) and the discharge pulse PS1 (subsequent) are continuously applied to the piezoelectric element 433 will be described. In this case, since the movement of the meniscus up timing t3 is the same as the case where only the discharge pulse PS1 (previous) is applied to the piezoelectric element 433, the description thereof will be omitted. The application of the discharge pulse PS1 (subsequent) to the piezoelectric element 433 from timing t3 is started. At this time, the meniscus is moved to the discharge side by the residual vibration caused by the application of the discharge pulse PS1 (previous) to the piezoelectric element 433. On the other hand, the decompression portion P1 of the discharge pulse PS1 (subsequent) is applied to the piezoelectric element 433, so that the pressure chamber 424 is expanded to thereby depressurize the ink within the pressure chamber 424. The energy caused by the residual vibration and the energy caused by the expansion of the pressure chamber 424 are offset. Here, since the energy provided to the ink by the decompression portion P1 is larger than the energy caused by the residual vibration, the meniscus is drawn into the pressure chamber 424 side. However, by the offset of the energies, drawing-in force of the meniscus is weaker than that of the case where the discharge pulse PS1 (subsequent) is solely applied to the piezoelectric element 433. Meanwhile, in FIG. 6, although the amount of ink at timing t4 is in step with the amount of ink at timing t1, this is considered as drawing of the meniscus in the pressure chamber 424 side at timing t3 in the point of time of the application start of the decompression portion P1. At timing t4, the direction of movement of the meniscus is reversed, and the pressurization portion P3 is applied to the piezoelectric element 433. For this reason, the meniscus is moved to the discharge side at high speed. At timing t5, although a portion of the tip of the columnar meniscus is cut off and is discharged in a droplet-like shape, the amount F2 of ink at timing t5 is smaller than the amount F1 of ink by the discharge pulse PS1 (previous). This is considered as caused by the offset of the above-mentioned energies.

In the reference example, when the discharge pulse PS1 (previous) and the discharge pulse PS1 (subsequent) are continuously applied to the piezoelectric element 433, the amount of the ink drops corresponding to the discharge pulse PS1 (subsequent) becomes smaller than the amount of the ink drops corresponding to the discharge pulse PS1 (previous). In addition, at timing t4, since the energy moving the meniscus to the discharge side becomes smaller compared to the case where the discharge pulse PS1 (subsequent) is solely applied by the offset, the flying speed of the ink drops also becomes relatively slow. Herewith, the dot landing position deviates, to thereby cause image degradation.

With Respect to Discharge Operation

Outline

To taking the circumstances into consideration, the drive signal generating circuit 30 according the embodiment generates the non-discharge pulse PS2 between the discharge pulse PS1 (which is equivalent to first discharge pulse) previously applied to the piezoelectric element 433 and the discharge pulse PS1 (which is equivalent to second discharge pulse) subsequently applied to the piezoelectric element 433. The non-discharge pulse PS2 is configured so that the generation timing or the waveform thereof is set so as to give change of pressure, by which the ink drops are not discharged from the nozzles 427, to the ink within the pressure chamber 424, the non-discharge pulse having a phase different from pressure vibration produced in the ink within pressure chamber 424 by the application of the previous first discharge pulse PS1 to the piezoelectric element 433. The head control section HC applies the non-discharge pulse PS2 to the piezoelectric element 433, prior to the application of the subsequent discharge pulse PS1 to the piezoelectric element 433. Although the piezoelectric element 433 to which the subsequent discharge pulse PS 1 is applied performs an operation for discharging the ink drops, pressure vibration produced by the non-discharge pulse PS2 is used in the operation to provide constructive interference to the subsequent discharge pulse PS1. Herewith, it is possible to suppress the effect of pressure vibration produced by the application of the previous discharge pulse PS1, and to assist discharge of the ink by the application of the subsequent discharge pulse PS1. As a result, it is suppress lack of the amount or lack of flying speed with respect to the ink drops discharged by the application of the subsequent discharge pulse PS 1. Hereinafter, the description thereof will be made in detail.

With Respect to Drive Signal COM

First, the drive signal COM generated by the drive signal generating circuit 30 will be described. As shown in FIG. 7, the drive signal COM according to the embodiment includes a plurality of discharge pulses PS1 and a plurality of non-discharge pulses PS2, and is repeatedly generated for each repetition period T. The repetition period T is a period corresponding to one dot.

The discharge pulse PS1 is constituted by trapezoidal waves having a decompression portion P1, a maintenance portion P2, and a pressurization portion P3 as described in the reference example. The non-discharge pulse PS2 is also is constituted by trapezoidal waves having a decompression portion P1', a maintenance portion P2', and a pressurization portion P3'. Great difference from the discharge pulse PS1 lies in wave height. In the embodiment, the wave height of the non-discharge pulse PS2 is set to be somewhat lower than half of the wave height of the discharge pulse PS1.

Each of the pulses PS1 and PS2 is all constituted by trapezoidal waves of which a initiation voltage and a termination voltage are minimum voltages (minimum voltages of the drive signal COM in the example) of each of the pulses PS1 and PS2. Since the initiation voltage and the termination voltage are minimum voltages of each of the pulses PS1 and PS2, it is possible to greatly take the amount of change of the capacity at time of expansion or contraction of the pressure chamber 424, in the discharge pulse PS1. That is, it is possible to sufficiently secure voltage difference in the decompression portion P1 or the pressurization portion P3 of the discharge pulse PS1, and to heighten expansion rate or contraction rate of the pressure chamber 424. Herewith, it is possible to strongly draw the high viscosity ink into the pressure chamber 424 side, or to strongly extrude the ink to the discharge side. As a result, it is possible to efficiently discharge the high viscosity ink. In addition, since each of the pulses PS1 and PS2 is a trapezoidal wave, time requisite to generation of each of the pulses PS1 and PS2 may be shortened, and each of the pulses is appropriate for high-frequency discharge of the ink drops. In addition, since the non-discharge pulse PS2 is also constituted by a trapezoidal wave, strength of pressure vibration may be adjusted by the wave height, and the waveform design is easily performed.

These discharge pulse PS1 and the non-discharge pulse PS2 are applied to the piezoelectric element 433 in sets, respectively. For example, when three dots are continuously formed, the switch 44 becomes an on (connected) state at each of the repetition periods T on the basis of a switch control signal [111]. Herewith, each of the pulses PS1 and PS2 is applied to the piezoelectric element 433 at each of the repetition periods T, the ink drops are discharged from the nozzles 427.

In addition, when two dots are continuously formed, and no dot is formed at the next period T, the switch 44 becomes on state at the first and second repetition periods T, and the switch 44 becomes off state at the third repetition period T, on the basis of the switch control signal [110]. Similarly, when the dot formation and non-formation are alternately performed, the switch 44 becomes on state at the first and third repetition periods T, the switch 44 becomes off state at the second repetition period T, on the basis of the switch control signal [101].

Here, when the dots are continuously formed, the non-discharge pulse PS2 included in the previous repetition period is applied to the piezoelectric element 433 prior to the subsequent discharge pulse PS1. By intermediation of the non-discharge pulse PS2, the discharge pulse PS1, the non-discharge pulse PS2, and the discharge pulse PS1 are in order applied to the piezoelectric element 433, and the piezoelectric element 433 performs an operation of expansion and contraction corresponding to waveforms of each of the pulses PS1 and PS2. By the operation of expansion and contraction, first, change of pressure in accordance with the previous discharge pulse PS 1 is provided to the ink within the pressure chamber 424, and the ink drops are discharged from the nozzles 427. After that, change of pressure in accordance with the non-discharge pulse PS2 is provided to the ink within the pressure chamber 424, and pressure vibration of a phase different from residual vibration subsequent to ink drop discharge is exited. After that, change of pressure in accordance with the subsequent discharge pulse PS1 is provided to the ink within the pressure chamber 424, and the ink drops are discharged from the nozzles 427. At this time, since constructive interference occurs with pressure vibration produced by the non-discharge pulse PS2, it is possible to effectively use pressure vibration produced by the application of the subsequent discharge pulse PS1 in discharge of the ink drops, while suppressing the effect of pressure vibration produced by the application of the previous discharge pulse PS1. As a result, it is possible to suppress lack of the amount or flying speed with respect to the ink drops discharged.

With Respect to Action of Non-Discharge Pulse PS2

Here, the action of the above-mentioned non-discharge pulse PS2 will be described. FIG. 8 is a diagram for describing the action of the non-discharge pulse PS2, is a diagram for describing the state of the meniscus in the case where the discharge pulse PS1, the non-discharge pulse PS2, and the discharge pulse PS1 are in order applied to the piezoelectric element 433. That is, the top stage of the drawing is a diagram for describing the state of the meniscus in the case where the previous discharge pulse PS1 (first discharge pulse) is applied to the piezoelectric element 433, and is a diagram for describing the state of the meniscus in the case where the non-discharge pulse PS2 is applied to the piezoelectric element 433. In addition, the third stage from the top is a diagram for describing the state of the meniscus in the case where the subsequent discharge pulse PS1 (second discharge pulse) is applied to the piezoelectric element 433, and the bottom stage thereof is a diagram for describing the state of the meniscus in the case where each of the above-mentioned pulses PS1, PS2, and PS1 is continuously applied to the piezoelectric element 433.

In addition, the movement of the meniscus in the case where the discharge pulse PS1 is solely applied to the piezoelectric element 433 will be described.

The movement of the meniscus in this case is similar to the movement of the meniscus described in the reference example. To put it briefly, with respect to the discharge pulse PS1 of the period T3, the application of the decompression portion P1 is started from timing t0 and then the meniscus is drawn into the pressure chamber 424 side. At timing t11 when the drawn meniscus is reversed and the direction of movement thereof is switched to the discharge side, the application of the pressurization portion P3 is started. Herewith, the meniscus is extruded, and is discharged as ink drops of the amount F1 of ink at timing t12. After discharge of the ink drops the meniscus performs free vibration. For example, at timing t13, the drawn meniscus is reversed and then the direction of movement thereof is switched to the discharge side. In addition, at timing t14, the extruded meniscus is reversed and then the direction of movement thereof is switched to the pressure chamber 424 side. The strength of the residual vibration after discharge of the ink drops is represented by the amplitude of the meniscus. In the example, the residual vibration of the strength equivalent to the amount F3 of ink is produced. In addition, with respect to the discharge pulse PS1 of the period T5, the application of the decompression portion P1 is started from timing t16, and the ink drops of the amount F1 of ink are discharged at timing t17. Production of the residual vibration after discharge of the ink drops is similar to the case in the discharge pulse PS1 of the period T3.

Next, the movement of the meniscus in the case where the non-discharge pulse PS2 is solely applied to the piezoelectric element 433 will be described.

In the non-discharge pulse PS2, the application of the decompression portion P1' is started from timing t13. Herewith, the pressure chamber 424 is expanded and then the ink within the pressure chamber 424 becomes negative pressure. The meniscus is drawn into the pressure chamber 424 side within the nozzles 427. The movement of the pressure chamber 424 side of the meniscus is continued even in the application of the maintenance portion P2'. In timing t14, the drawn meniscus is reversed and then the direction of movement thereof is switched to the discharge side. The pressurization portion P3' is applied in accordance with the movement to a discharge direction of the meniscus, and the movement of the meniscus is accelerated. The non-discharge pulse PS2 has a wave height set so as for the ink drops not to be discharged from the nozzles 427. For this reason, the vibration state of the meniscus subsequent to timing t15 continues the vibration state previous to that. In other words, the meniscus does not return to the pressure chamber 424 side rapidly, and retroaction associated with discharge of the ink drops does not take place. It is determined that the pressure vibration of the strength equivalent to the amount F4 of ink is excited by the ink within the pressure chamber 424, by applying the non-discharge pulse PS2 to the piezoelectric element 433, from the amplitude of the meniscus. The pressure vibration is stronger than the residual vibration (residual vibration in the application period of the non-discharge pulse PS2) by the previous discharge pulse PS1.

Next, the movement of the meniscus in the case where each of the above-mentioned pulses PS1, PS2, and PS1 is continuously applied to the piezoelectric element 433 will be described.

In this case, timing t13 to be taken until the application of the non-discharge pulse PS2 is started is similar to the case where the previous discharge pulse PS1 is solely applied. The application of the decompression portion P1' included in the non-discharge pulse PS2 is started from timing t13. Here, the pressure vibration in the case where the previous discharge pulse PS1 is solely applied, and the pressure vibration in the case where the non-discharge pulse PS2 is solely applied have phases reverse to each other. For this reason, energy which draws the meniscus by the decompression portion P1', and energy which move the meniscus by the residual vibration in a discharge direction are offset, and the meniscus maintains the drawn state in the period up to timing t14. Since the application of the pressurization portion P3' is started after a lapse of timing t14, the meniscus starts the movement to the discharge side. When determined compared to the movement of the meniscus in the case where the non-discharge pulse PS2 is solely applied, the pressure vibration subsequent to timing t14 has the same phase as pressure vibration in the case where the non-discharge pulse PS2 is solely applied. From this, the non-discharge pulse PS2 is applied, so that the phase of the pressure vibration provided to the ink within the pressure chamber 424 is shifted. This makes still clearer, compared to the movement of the meniscus of the reference example shown by a dashed line in the drawing.

The application of the subsequent discharge pulse PS1 is started from timing t16. Here, the pressure vibration in the case where the non-discharge pulse PS2 is solely applied, and the pressure vibration in the case where the subsequent discharge pulse PS1 is solely applied have the same phases. For this reason, decompression of ink by application of the decompression portion P1 and pressurization of ink by application of the pressurization portion P3 are assisted by constructive interference with the residual vibration subsequent to the application of the non-discharge pulse PS2. That is, the pressure vibration is strengthened. As a result, the amount F5 of the ink drops discharged by the subsequent discharge pulse PSI is increased more than the amount F3 of the ink drops discharged by the previous discharge pulse PS1.

As described above, in the embodiment, the non-discharge pulse PS2 is generated between the previous discharge pulse PS 1 and the subsequent discharge pulse PS1, and the non-discharge pulse PS2 is applied to the piezoelectric element 433 prior to the application of the subsequent discharge pulse PSI to the piezoelectric element 433. For this reason, it is possible to suppress the effect of the residual vibration by the previous discharge pulse PS1. In addition, the pressure vibration by the non-discharge pulse PS2 has a higher amplitude than the residual vibration, and has the same phase as the pressure vibration by the subsequent discharge pulse PS1.

Therefore, it is possible to assist the discharge of the ink drops by the subsequent discharge pulse PS1 through constructive interference with the residual vibration by the non-discharge pulse PS2.

With Respect to Specific Example

Figure 10:
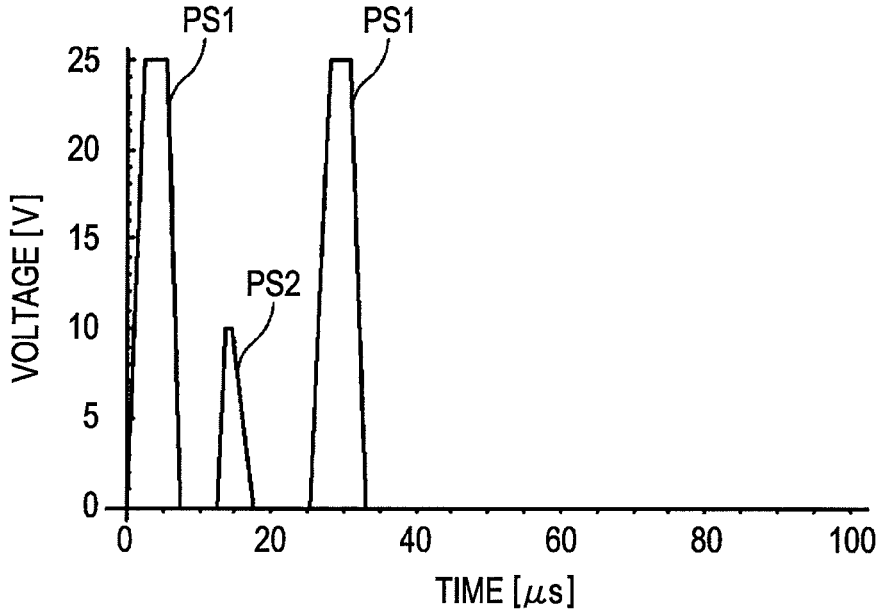
FIG. 10 is a diagram for describing each of the pulses according to the first embodiment.

Hereinafter, the above-mentioned operational advantage will be concretely described on the basis of the simulation result. First of all, the simulation result according to the embodiment is described. Here, FIG. 9 is a diagram illustrating the movement of the meniscus in the case where two discharge pulses PS1 and PS1 and one non-discharge pulse PS2 are continuously applied to the piezoelectric element 433. In addition, FIG. 10 is a diagram for describing each of the pulses P51, PS2, and PS1 using this simulation. In the simulation, with respect to the discharge pulse PS1, a generation period of the decompression portion P1 is 2.5 μs, a generation period of the maintenance portion P2 is 2.0 μs, a generation period of the pressurization portion P3 is 3.0 μs, and a wave height is 25 V. in addition, with respect to the non-discharge pulse PS2, a generation period of the decompression portion P1' is 2.0 μs, a generation period of the maintenance portion P2' is 1.0 μs, a generation period of the pressurization portion P3' is 2.5 μs, and a wave height is 10 V. Meanwhile, viscosity of ink is 15 mPa·s. In the embodiment, the ink drops of about 12 ng are discharged by the previous discharge pulse PS1 (t12), and the ink drops of about 13 ng are discharged by the subsequent discharge pulse PS1 (t16). The fact that the subsequent discharge pulse PS1 has larger discharge amount of the ink drops than the previous discharge pulse PS1 is considered as the action by the non-discharge pulse PS2, as described above.

Figure 11:
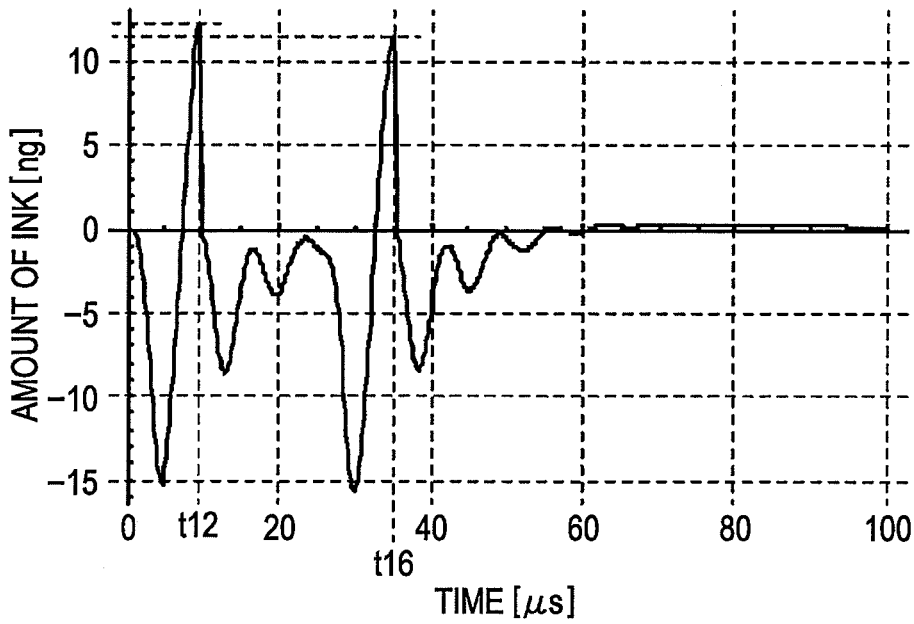
FIG. 11 is a diagram illustrating simulation data for describing a first comparative example.
Figure 12:
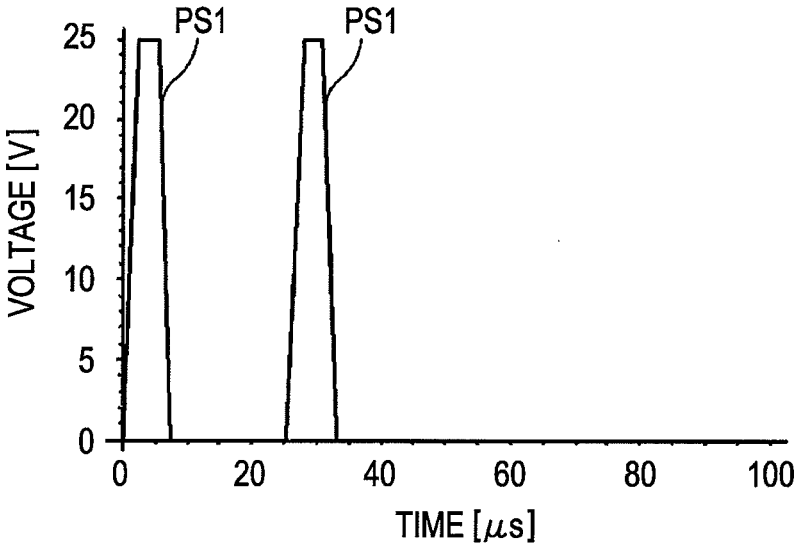
FIG. 12 is a diagram for describing each of the pulses of the first comparative example.

Next, a simulation result of the first comparative example will be described. Here, FIG. 11 is a diagram illustrating the movement of the meniscus in the case where two discharge pulses PS1 and PS1 are continuously applied to the piezoelectric element 433. In addition, FIG. 12 is a diagram for describing each of the discharge pulses PS1 and PS1 using this simulation. The discharge pulse PS1 of the simulation has the same waveform as the discharge pulse PS1 described in the embodiment. In addition, generation timing of each of the discharge pulses PS1 and PS1 or viscosity of ink is the same as that of the embodiment. In the first comparative example, the ink drops of about 12 ng are discharged by the previous discharge pulse PS1 (t12), and the ink drops of slightly over about 11 ng are discharged by the subsequent discharge pulse PS1 (t16). The fact that the subsequent discharge pulse PS1 has smaller discharge amount of the ink drops than the previous discharge pulse PS1 is construed as the reason that energy of decompression by the decompression portion P1 of the subsequent discharge pulse PS1 has consumed by the residual vibration of the previous discharge pulse PS1, as described above.

Figure 13:
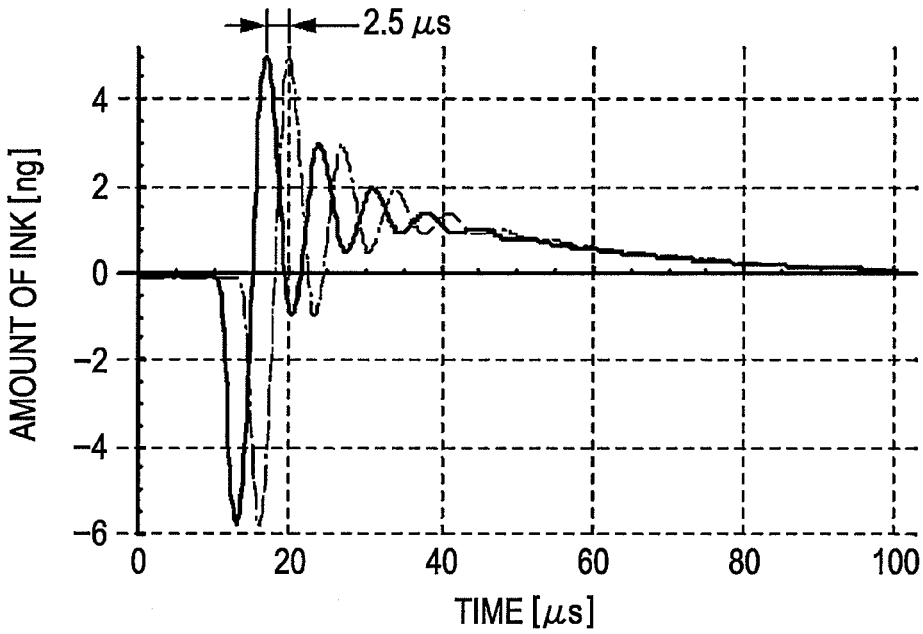
FIG. 13 is a diagram for describing a state change of the meniscus by a second comparative example.
Figure 14:
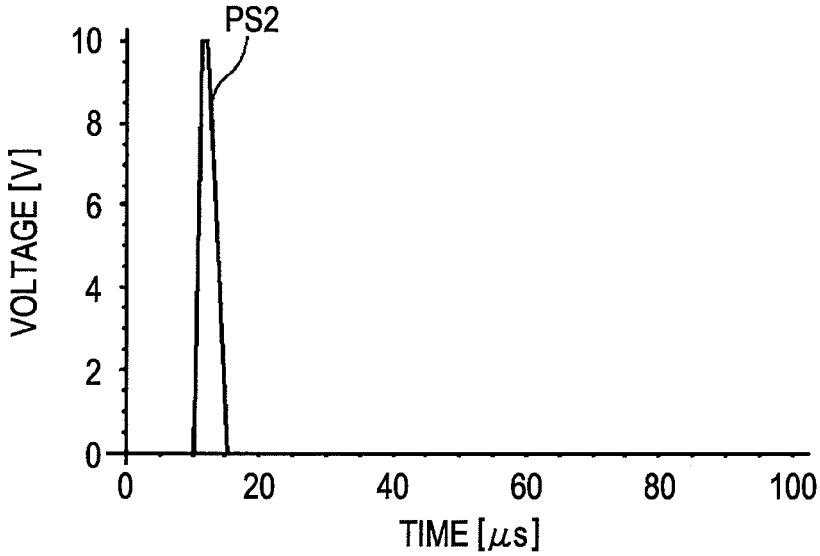
FIG. 14 is a diagram for describing a non-discharge pulse of the second comparative example.
Figure 15:
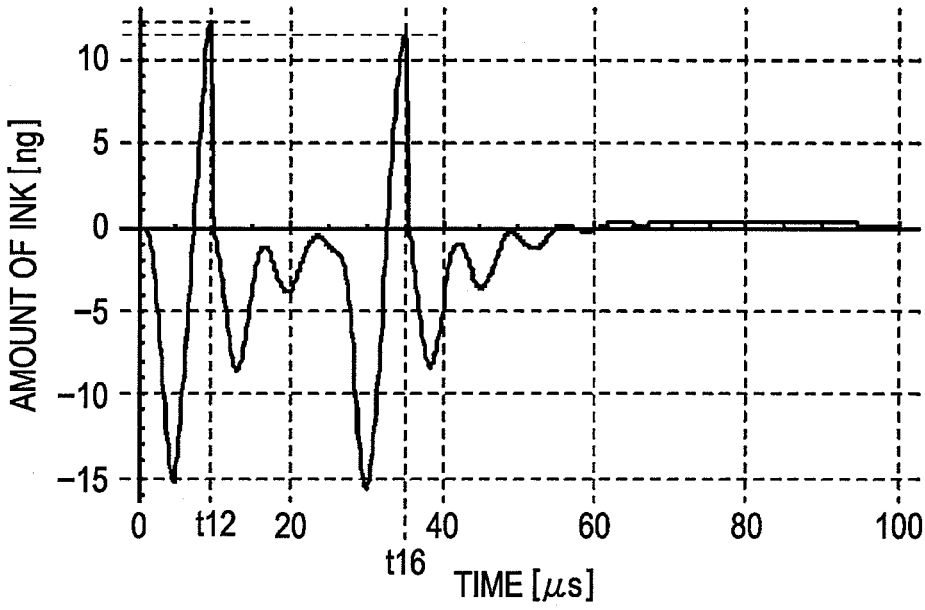
FIG. 15 is a diagram illustrating simulation data for describing the second comparative example.

Next, a simulation result of the second comparative example will be described. In the second comparative example, generation timing of the non-discharge pulse PS2 is set to be earlier than generation timing of the non-discharge pulse PS2 according to the embodiment. In particular, as shown in FIG. 14, generation of the non-discharge pulse PS2 is started at a point of time of 10 μs having lapsed from generation start of the previous discharge pulse PS1. As determined from the comparison with FIG. 10, the timing is earlier by 2.5 μs than generation timing the non-discharge pulse PS2 according to the embodiment. Herewith, as shown in FIG. 13, the phase of the pressure vibration is shifted forward by 2.5 μs. Meanwhile, the waveform of the non-discharge pulse PS2, the waveforms and the generation timing of each of the discharge pulses PS1 and PS1 are the same as those of the embodiment. In the modified example, the ink drops of about 12 ng are discharged by the previous discharge pulse PS1 (t12), and the ink drops of slightly over about 11.5 ng are discharged by the subsequent discharge pulse PS1 (t16). The subsequent discharge pulse PS1 has smaller discharge amount of the ink drops than the previous discharge pulse PS1. This is construed as the reason that deviation is generated between the phase of the residual vibration by the non-discharge pulse PS2 and the phase of the pressure vibration provided to the subsequent discharge pulse PS1.

Therefore, it is known that to sufficiently obtain the operational advantage by the non-discharge pulse PS2, a distance between the previous discharge pulse PS1 and the non-discharge pulse PS2, and a distance between the non-discharge pulse PS2 and the subsequent discharge pulse PS1 are important. It is preferable to change the strength of the pressure vibration or the generation timing of the non-discharge pulse PS2 in response to the distance of the previous discharge pulse PS1 and the non-discharge pulse PS2. At this point, the non-discharge pulse PS2 according to the embodiment is a trapezoidal wave, thereby allowing the strength of the pressure vibration to be easily changed by the change of a wave height, and a waveform design is easily performed.

Conclusion

As described above, in the printer 1 according to the embodiment, the non-discharge pulse PS2 is generated after the previous discharge pulse PS1, and the subsequent discharge pulse PS1 is generated after the non-discharge pulse PS2. The phase of the residual vibration of the previous discharge pulse PS1 is shifted by the non-discharge pulse PS2, and the phase of the pressure vibration provided by the subsequent discharge pulse PS1 is adjusted. For this reason, at the time of the discharge of the ink drops by the subsequent discharge pulse PS1, it is possible to suppress the effect of the residual vibration by the previous discharge pulse PS1, and to assist the discharge of the ink drops by the application of the subsequent discharge pulse PS1. In addition, the residual vibration of the non-discharge pulse PS2 acts so as to strengthen the pressure vibration by the subsequent discharge pulse PS1. For this reason, it is possible to give great pressure vibration to the ink within the pressure chamber 424 at the time of the discharge operation of the ink drops by the subsequent discharge pulse PS1. In addition, the pressure vibration provided to the ink within the pressure chamber 424 by the non-discharge pulse PS2 is stronger than the residual vibration in the application period of the non-discharge pulse PS2. Therefore, it is possible to effectively suppress the effect of the residual vibration by the previous discharge pulse PS1. In addition, since the discharge pulse PS1 and the non-discharge pulse PS2 are all constituted by trapezoidal waves, they are appropriate for high frequency discharge of the ink drops.

With Respect to Other Embodiments

Although the above-mentioned embodiments are mainly described with respect to the printing systems including the printer 1 used as a liquid discharging apparatus, the disclosures of the liquid discharging method or the liquid discharging system are included among them. In addition, the disclosures of the liquid discharging head or the method of controlling the liquid discharging head are also included. Further, the embodiments are for the purpose of facilitating the comprehension of the invention, and the invention is not construed by limiting to the embodiments. The invention may be changed and modified departing from the gist of the invention, and it goes without saying that the equivalents thereof are included in the invention as a matter of course. In particular, the embodiments described below are included in the invention as well.

With Respect to Grayscale Control

The above-mentioned embodiments have described the cases where on/off control of dots is performed as an example, but are not limited to the control thereof. It is also possible to perform multi-grayscale control. Hereinafter, the multi-grayscale control will be described.

Figure 16:
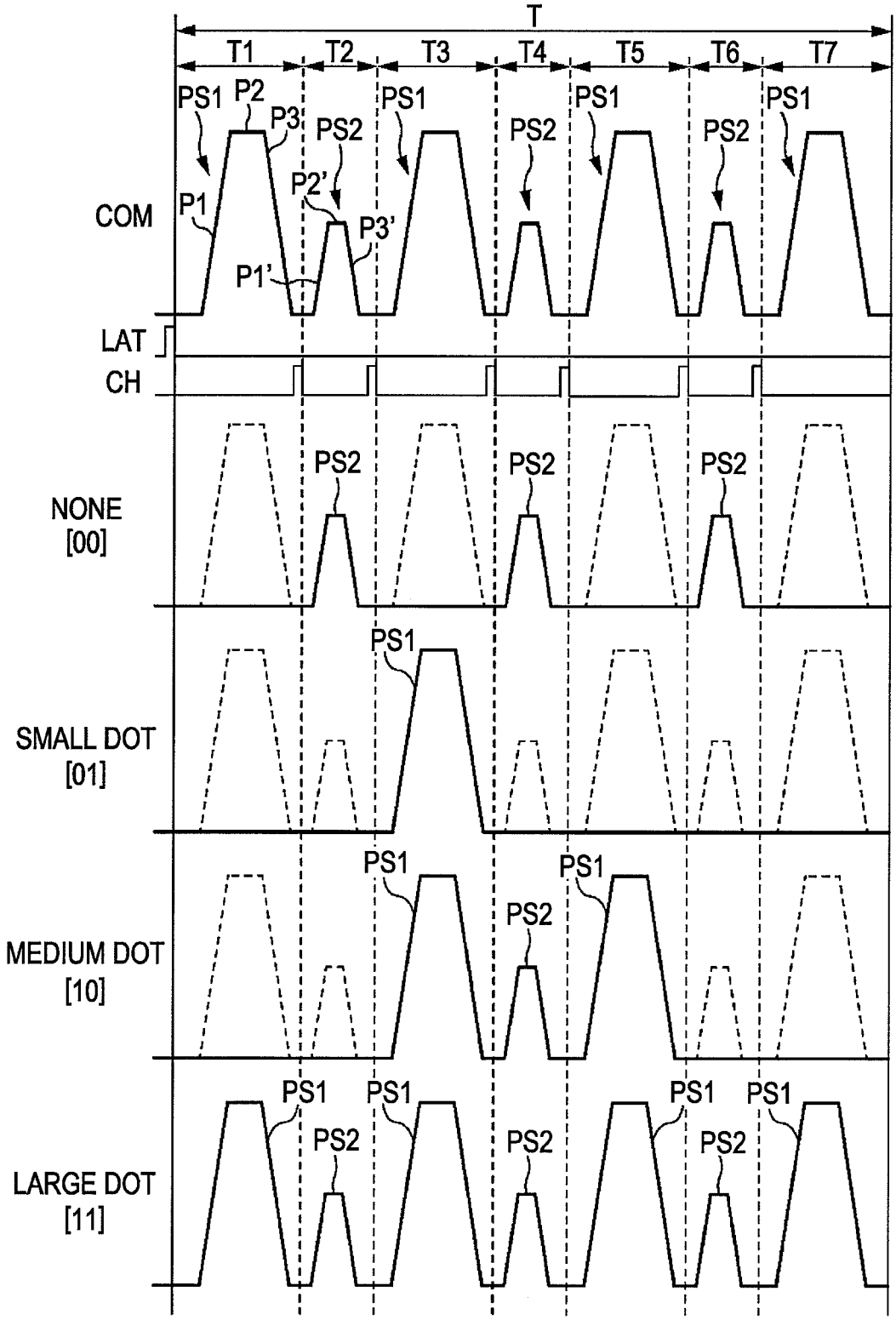
FIG. 16 is a diagram for describing drive signals and dot grayscale control according to another embodiment.

As shown in FIG. 16, the drive signal COM used in multi-grayscale includes a plurality of discharge pulses PS1 and a plurality of non-discharge pulses PS2, and is repeatedly generated for each repetition period T. These discharge pulse PS1 and non-discharge pulse PS2 each may be individually applied to the piezoelectric element 433. For example, in a grayscale value [00] having no dot by which the ink drops are not discharge, the switch 44 becomes an on (connected) state at each period T2, period T4, and period T6, and the drive signal COM is applied to the corresponding piezoelectric element 433. Herewith, three non-discharge pulses PS2 are applied to the piezoelectric element 433, and the piezoelectric element 433 performs an operation of expansion and contraction corresponding to the waveform of the non-discharge pulse PS2. The change of pressure equivalent to the extent that the ink drops are not discharged from the nozzles 427 is provided to the ink within the pressure chamber 424. As a result, the meniscus vibrates minutely in the discharge side and the pressure chamber 424 side by the nozzles 427, viscosity increase of the ink adjacent to the nozzles 427 is suppressed.

In a grayscale value [01] of a small dot, the switch 44 becomes an on state at the period T3, and the drive signal COM is applied to the corresponding piezoelectric element 433. Herewith, one discharge pulse PS1 is applied to the piezoelectric element 433, and the piezoelectric element 433 performs an operation of expansion and contraction corresponding to the waveform of the discharge pulse PS1. By the operation of expansion and contraction, the change of pressure which is stronger than that of the case where the non-discharge pulse PS2 is solely applied to the piezoelectric element 433 is provided to the ink within the pressure chamber 424, and the ink drops corresponding to the amount requisite to form the small dot from the nozzles 427 are discharged.

In a grayscale value [10] of a medium dot, the switch 44 becomes an on state at period T3, period T4, and period T5, and the drive signal COM is applied to the corresponding piezoelectric element 433. Herewith, the discharge pulse PS1, the non-discharge pulse PS2, and the discharge pulse PS1 are in order applied to the piezoelectric element 433, and the piezoelectric element 433 performs an operation of expansion and contraction corresponding to the waveforms of each of the pulses PS1 and PS2.

As described above, in this case, the change of pressure in response to the previous discharge pulse PS1 (first discharge pulse) is first provided to the ink within the pressure chamber 424, and the ink drops are discharged from the nozzles 427. After that, the change of pressure in response to the non-discharge pulse PS2 is provided to the ink within the pressure chamber 424, and the pressure vibration having a phase different from the residual vibration after discharge of the ink drops is exited. After that, the change of pressure in response to the subsequent discharge pulse PS1 (second discharge pulse) is provided to the ink within the pressure chamber 424, and the ink drops are discharged from the nozzles 427. At this time, since the pressure vibration produced by the non-discharge pulse PS2 is used, it is possible to effectively use the pressure vibration produced by the application of the subsequent discharge pulse PS1 in the discharge of the ink drops, while suppressing the effect of the pressure vibration produced by the application of the previous discharge pulse PS1. As a result, with respect to the ink drops discharged, lack of the amount or flying speed thereof may be suppressed.

In a grayscale value [11] of a large dot, the switch 44 becomes an on state extending from the period T1 to the period T7, and the drive signal COM is applied to the corresponding piezoelectric element 433. Herewith, the discharge pulse PS1, the non-discharge pulse PS2, the discharge pulse PS1, . . . are in order applied to the piezoelectric element 433, and the piezoelectric element 433 performs an operation of expansion and contraction corresponding to the waveforms of each of the pulses PS1 and PS2. In this case, the discharge pulse PS1 of the period T1 is equivalent to a previous discharge pulse with respect to the discharge pulse PS1 of the period T3 (the discharge pulse PS1 of the period T3 becomes a subsequent discharge pulse). In addition, the discharge pulse PS1 of the period T3 is equivalent to a previous discharge pulse with respect to the discharge pulse PS1 of the period T5, and the discharge pulse PS1 of the period T5 is equivalent to a previous discharge pulse with respect to the discharge pulse PS1 of the period T7. In the grayscale value of the large dot, prior to the application of the subsequent discharge pulse PS1 (discharge pulse PS1 of period T3, T5, and T7) to the piezoelectric element 433, the non-discharge pulse PS2 is applied to the piezoelectric element 433. Therefore, as described in the grayscale value of the medium dot, with respect to the ink drops discharged by the application of the subsequent discharge pulse PS1, lack of the amount or flying speed thereof may be suppressed.

With Respect to Element Performing Discharge Operation

In the above-mentioned embodiment, the piezoelectric element 433 is used as an element which performs an operation for discharging ink. Here, the element which performs the discharge operation is limited to the above-mentioned piezoelectric element 433. There may be an element which performs an operation in response to a voltage of a signal applied, and provides change of pressure to liquid within the pressure chamber 424. For example, the element may also be a magnetostrictive element. When the piezoelectric element 433 is used as the element as in the above-mentioned embodiment, it is possible to control the capacity of the pressure chamber 424 with a good degree of accuracy on the basis of voltages of each of the pulses PS1 and PS2. That is, it is possible to delicately control pressure provided to the ink within the pressure chamber 424.

With Respect to Drive Signal Generating Circuit

In the above-mentioned embodiment, the single drive signal COM has generated by the drive signal generating circuit 30. Here, a plurality of kinds of drive signals may be generated from the drive signal generating circuit 30. For example, a first drive signal including each discharge pulse PS1 and a second drive signal including each non-discharge pulse PS2 may be generated. In this case, the head control section HC applies a requisite portion of the first drive signal and a requisite portion of the second drive signal to the piezoelectric element. In addition, the drive signal generating circuit 30 may be constituted by using analog elements such as a transistor, a resistor, and a capacitor.

With Respect to Drive Signal

In the above-mentioned drive signal COM, although the discharge pulse PS1 has been generated at the head of the repetition period T (period T1), the non-discharge pulse PS2 may be generated at the head of the repetition period T. In this case, the non-discharge pulse PS2 and the discharge pulse PS1 are alternately generated at the repetition period T. When configured in this manner, in the case where the period from the last discharge pulse PS1 at the previous repetition period T to the initial discharge pulse PS1 at the subsequent repetition period T is short, a phase of the residual vibration by the last discharge pulse PS1 at the previous repetition period T may be shifted by the initial non-discharge pulse PS2 at the subsequent repetition period T. Herewith, with respect to the ink drops by the initial discharge pulse PS1 at the subsequent repetition period T, lack of the amount or flying speed thereof may be suppressed.

In addition, the waveform of the discharge pulse is not limited to a trapezoidal wave. As in the above-mentioned embodiment, the discharge pulse is constituted by the trapezoidal waves, so that it is appropriate for high frequency discharge of the ink drops.

Figure 17:
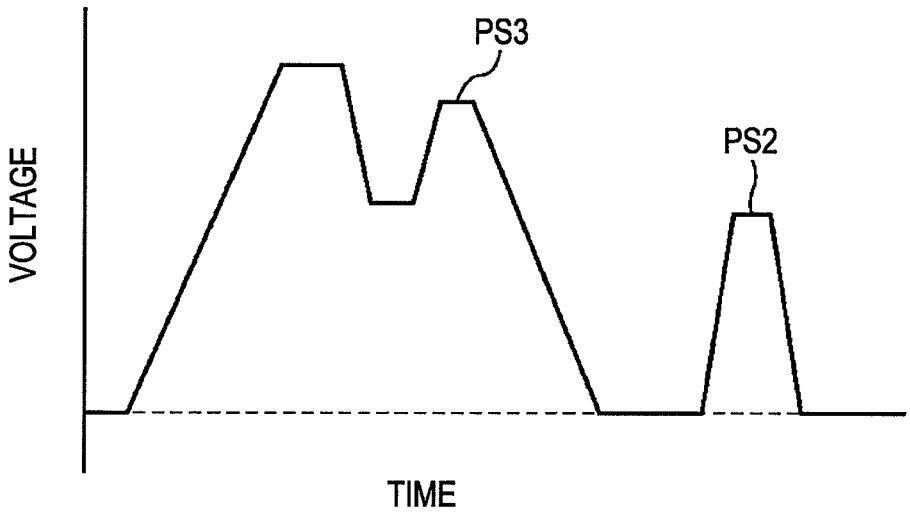
FIG. 17 is a diagram for describing a small-dot discharge pulse.

Further, as shown in FIG. 17, in the case of the pulse PS3 for a small dot repeating rise and drop of voltage, the change of pressure is repeatedly provided to the ink within the pressure chamber 424. As seen from the above, in the case of the pulse PS3 for a small dot by which the ink discharge is performed by repeatedly providing the minute change of pressure, ink is made more likely to be affected by the pressure vibration and the discharge amount or flying speed of the ink drops is changeable. Therefore, the effect of adjusting the pressure vibration by the non-discharge pulse PS2 is greatly exerted, compared to other dots (PS1 and the like).

In addition, since rise and drop of voltage are repeated even with respect to the waveform for performing operations of pull (drawing)-push (extrude)-pull (drawing), the effect of adjusting the pressure vibration by the non-discharge pulse PS2 is greatly exerted, compared to the trapezoidal wave.

With Respect to Viscosity of Ink

The above-mentioned embodiment has illustrated the ink of which the viscosity is 15 mPa·s, but is not limited to this viscosity. The lower limit of the viscosity which is set to be effective by the control according to the embodiment is 8 mPa·s or so. In addition, the upper limit of the viscosity is set to a value capable of discharging the ink drops by the head HD having a shape described in the embodiments. For example, supposing that ink is 30 mPa·s in viscosity, the ink drops may be discharged by the head HD having the shape.

With Respect to Other Applications

Further, in the above-mentioned embodiments, the printer 1 has been described as a liquid discharging apparatus, but is not limited to this. For example, the techniques comparable to those used for the embodiments may be applied to various types of liquid discharging apparatuses based on ink jet technology such as a color filter manufacturing apparatus, a dyeing apparatus, a microfabrication apparatus, a semiconductor manufacturing apparatus, a surface machining apparatus, a three-dimensional modeling apparatus, a liquid vaporizing apparatus, an organic EL manufacturing apparatus (particularly, macromolecular EL manufacturing apparatus), a display manufacturing apparatus, a film forming apparatus, a DNA chip manufacturing apparatus and the like. In addition, methods or manufacturing methods thereof fall into the categories of application range as well.

The entire disclosure of Japanese Patent Application No. 2009-023060, filed Feb. 3, 2009 is expressly incorporated by reference herein.

What is claimed is:

1. A liquid discharging apparatus comprising:

a pressure chamber communicating with a liquid supply portion and one or more nozzles;

an element that performs an operation for providing change of pressure to liquid within the pressure chamber; and a pulse generating section that generates a pulse of which a voltage is changed to operate the element, wherein the pulse generating section generates a first discharge pulse that causes the element to perform an operation for discharging liquid droplets from the nozzles, a non-discharge pulse, generated later than the first discharge pulse, that produces pressure vibration with an amplitude less than an amplitude required for the liquid droplets to be discharged from the nozzles, in the liquid within the pressure chamber, which has a phase different from pressure vibration produced in the liquid within the pressure chamber by applying the first discharge pulse to the element, and a second discharge pulse, generated later than the non-discharge pulse, that causes the element to perform the operation for discharging the liquid droplets from the nozzles, while using constructive interference between the pressure vibrations caused by the second discharge pulse and the non-discharge pulse, and wherein an amount of the ink drops discharged by the second discharge pulse is larger than an amount of the ink drops discharged by the first discharge pulse.

2. The liquid discharging apparatus according to claim 1, wherein the first discharge pulse comprises a first initiation voltage and a first termination voltage , wherein the first initiation voltage and the first termination voltage are both minimum voltages in the first discharge pulse.

3. The liquid discharging apparatus according to claim 2, wherein the non-discharge pulse comprises a second initiation voltage and a second termination voltage, wherein the second initiation voltage and the second termination voltage are both minimum voltages, and have a lower wave height than a wave height of the first discharge pulse.

4. A liquid discharging method of discharging liquid from one or more nozzles, using a liquid discharging apparatus including a pressure chamber communicating with a liquid supply portion and each of the nozzles, an element that performs an operation for providing change of pressure to liquid within the pressure chamber, and a pulse generating section that generates a pulse of which a voltage is changed to operate the element, comprising:

generating a first discharge pulse to apply the first discharge pulse to the element, and causing the element to perform an operation for discharging liquid droplets from the nozzles;

generating a non-discharge pulse later than the first discharge pulse to apply the non-discharge pulse to the element, and producing pressure vibration with an amplitude less than an amplitude required for the liquid droplets to be discharged from the nozzles, in the liquid within the pressure chamber, which has a phase different from pressure vibration produced in the liquid within the pressure chamber by the first discharge pulse; and generating a second discharge pulse later than the non-discharge pulse to apply the second discharge pulse to the element, and causing the element to perform the operation for discharging the liquid droplets from the nozzles, while using constructive interference between the pressure vibrations caused by the second discharge pulse and the non-discharge pulse, wherein an amount of the ink drops discharged by the second discharge pulse is larger than an amount of the ink drops discharged by the first discharge pulse.

* * * * *